US006592060B1

(12) United States Patent
Vomhof et al.

(10) Patent No.: US 6,592,060 B1
(45) Date of Patent: Jul. 15, 2003

(54) GRINDER FOR FROZEN AND FRESH MEAT

(75) Inventors: Paul Vomhof, Bad Laasphe (DE); Willi Eschenröder, Biedenkopf-Wallau (DE)

(73) Assignee: Tiromat Kramer & Grebe GmbH & Co. KG, Biedenkopf-Wallau (DE)

( * ) Notice: Subject to any disclaimer, the term of this patent is extended or adjusted under 35 U.S.C. 154(b) by 0 days.

(21) Appl. No.: 09/723,438

(22) Filed: Nov. 28, 2000

Related U.S. Application Data

(63) Continuation of application No. PCT/EP99/01261, filed on Feb. 26, 1999.

(30) Foreign Application Priority Data

May 28, 1998 (DE) ..... 298 09 485

(51) Int. Cl.[7] ..... B02C 18/30
(52) U.S. Cl. ..... 241/82.5; 241/82.4; 241/82.7
(58) Field of Search ..... 241/24.26, 82.4, 241/82.5, 82.7

(56) References Cited

U.S. PATENT DOCUMENTS

| | | | | | |
|---|---|---|---|---|---|
| 3,242,957 | A | * | 3/1966 | Provenzano | 100/136 |
| 4,003,521 | A | * | 1/1977 | Hess | 241/82.4 |
| 4,036,442 | A | * | 7/1977 | Barnes | 241/82.5 |
| 4,108,387 | A | * | 8/1978 | Weiler | 241/82.5 |
| 4,358,061 | A | * | 11/1982 | Richter | 241/82.4 |
| 4,422,372 | A | * | 12/1983 | Hoezee | 241/60 |
| 4,844,372 | A | | 7/1989 | Weiler et al. | |
| 5,092,528 | A | * | 3/1992 | Rudibaugh | 241/34 |
| 5,251,829 | A | * | 10/1993 | Lesar | 241/30 |
| 5,820,041 | A | * | 10/1998 | Moessmer et al. | 241/236 |
| 5,944,267 | A | * | 8/1999 | Haack et al. | 241/82.1 |
| 6,149,083 | A | * | 11/2000 | McFarland | 241/186.5 |

FOREIGN PATENT DOCUMENTS

| | | |
|---|---|---|
| DE | 810 243 C | 8/1951 |
| DE | 28 26 006 A1 | 1/1979 |
| DE | 296 22 298 U1 | 5/1998 |
| WO | WO 97/05953 | 2/1992 |

* cited by examiner

*Primary Examiner*—William Hong
(74) *Attorney, Agent, or Firm*—Akin Gump Strauss Hauer & Feld, L.L.P.

(57) ABSTRACT

A grinder, which is designed to cut frozen or fresh or fresh meat, has a set of blades, comprising a carving blade (2) and a perforated disc (4), in-between which a blade (3) is arranged in a defined fixed intermediate space. The blade (3) is spring-loaded and is pressed against the perforated disc with a preset force, so that wear can remain constant throughout the service life of the blade, and the service life of the blade can be enhanced.

7 Claims, 6 Drawing Sheets

GRINDER FOR FROZEN AND FRESH MEAT

CROSS-REFERENCE TO RELATED APPLICATION

This application is a continuation of International application Ser. No. PCT/EP99/01261 filed Feb. 26, 1999 the disclosure of which is incorporated herein by reference.

BACKGROUND OF THE INVENTION

The invention relates to a grinder, particularly for the grinding of frozen or fresh meat, with a worm conveyor, a drive shaft, and a set of blades which comprises a carving blade arranged after the worm conveyor, a perforated disc arranged at a fixed distance after the carving blade, and a driven blade which is arranged between the carving blade and the perforated disc, the set of blades being clamped with a cap nut in the worm housing.

Grinders of this type, in which the driven blade is inserted in an intermediate space created by a spacer ring between the perforated disc and the carving blade, are well-known. In this case it must be ensured that the driven blade has only very little play so that the cutting process is not impaired. A grinder designed in such a way is used for the cutting of frozen meat. If fresh meat is also to be cut by such a grinder, it has been necessary until now to replace the sets of blades and possibly also the worm conveyors, which are adapted to these sets of blades. In practice, the cutting tools and the worm conveyors usually have to be replaced several times daily, which entails a not inconsiderable degree of effort.

BRIEF SUMMARY OF THE INVENTION

The invention is based on the object of designing a grinder of the type described above, so that it is suitable both for the cutting of frozen meat and for the cutting of fresh meat without retooling and on which, in addition, the set of blades can be used for a much longer period of time.

According to the invention, this object is achieved in that the distance between the carving blade and the perforated disc is the same or slightly greater than the radial extension of the blades, and that the blade is axially displaceable on the drive shaft and pressed against the perforated disc with a predetermined initial load.

With a grinder according to the invention, the blade pressed with spring-loading against the perforated disc first of all achieves uniform cutting results, even with advancing wear. Second, it is also possible to process both fresh and frozen meat with good quality with the same set of blades without retooling. The reasons for this are that, owing to the constant preset cutting pressure, the cutting tools are guided with precision, the cutting pressure resulting from the components of the spring and of the product itself, thus yielding a product-specific cutting pressure. Since the blade automatically adjusts itself with advancing wear, cutting results remain constant over a very long period of time. Moreover, the excessive clamping of the set of blades, as conventionally occurs with the manual turning of the cap nut, is also eliminated. All of these factors also yield the advantage that the set of blades is not damaged by brief dry running. Furthermore, the initial loading of the blade is adjustable, so that the cutting pressure can be continuously adapted to different processing conditions.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
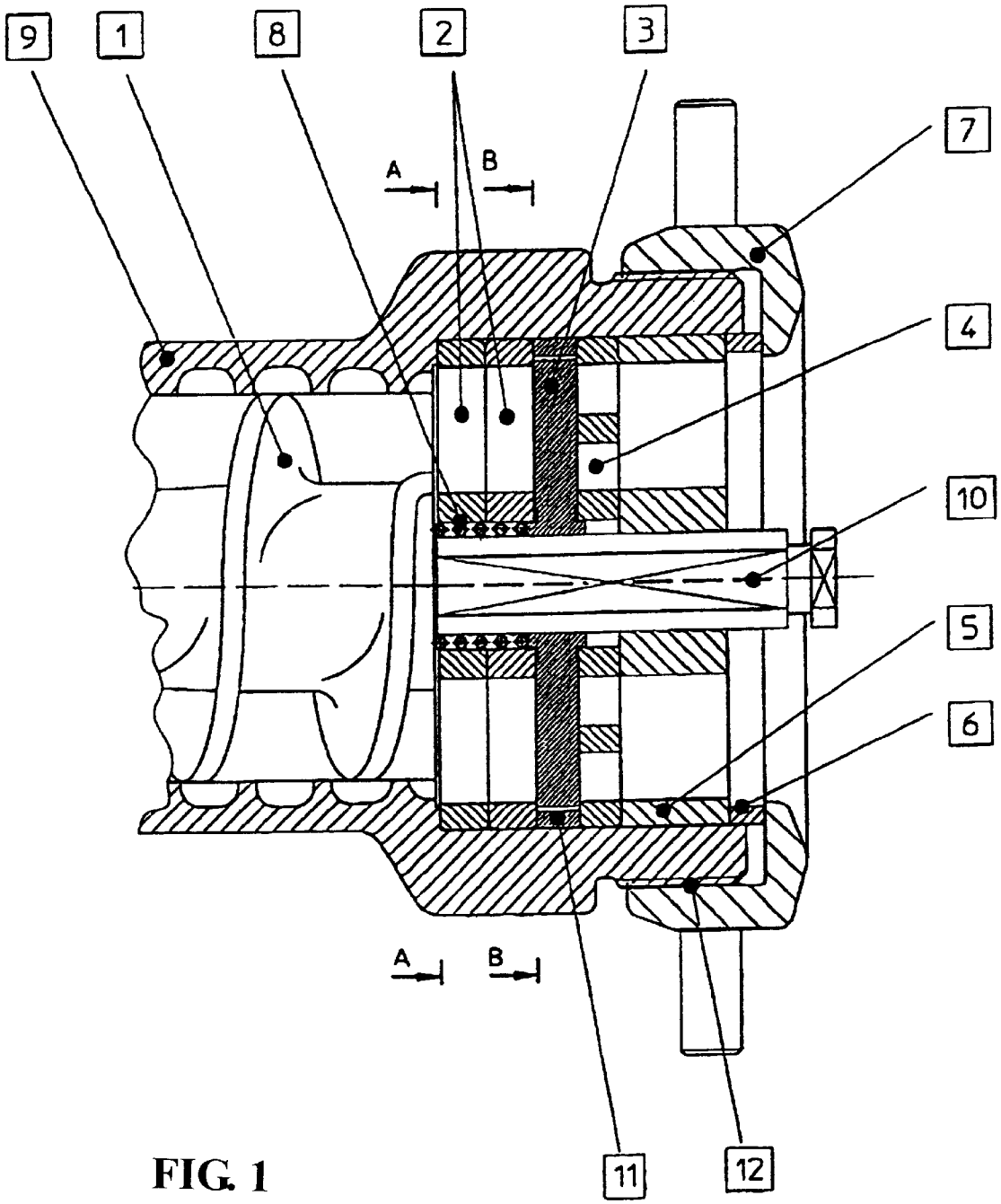
FIG. 1 is a lateral sectional view through a grinding machine according to the invention.
Figure 1A:
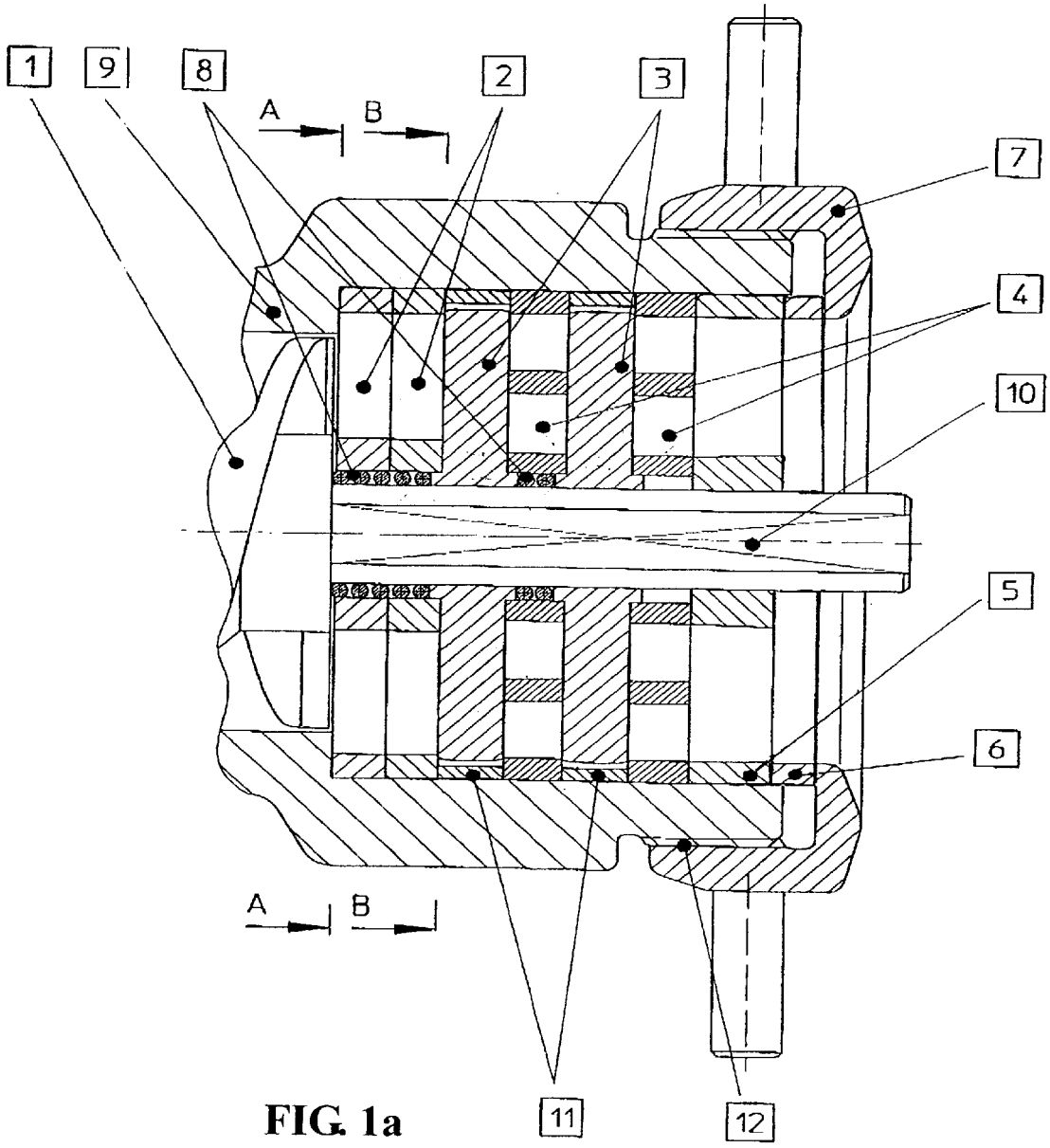
Figure 2:
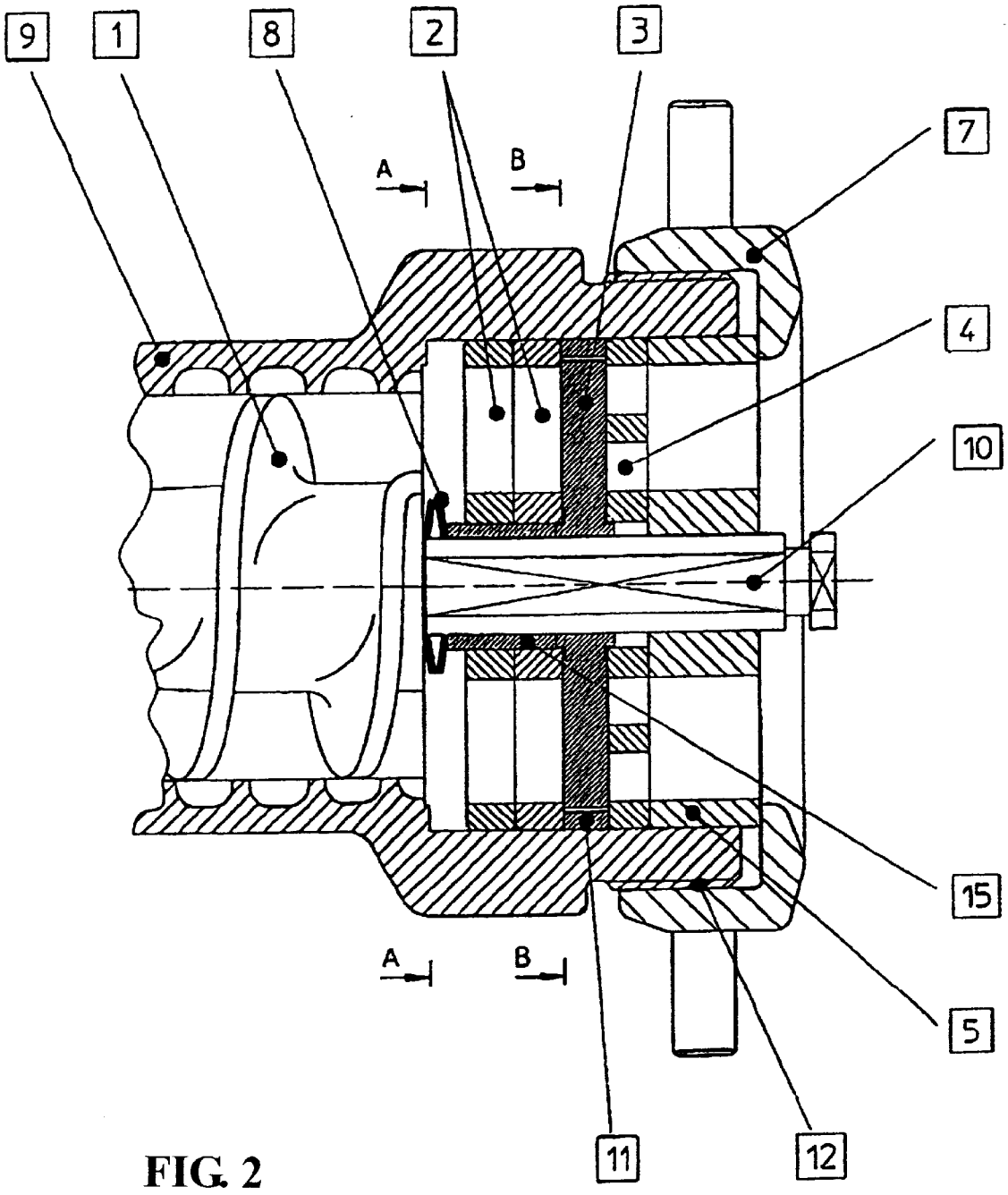
FIG. 2 is a lateral sectional view, similar to FIG. 1, of a different embodiment of a grinding machine according to the invention.
Figure 2A:
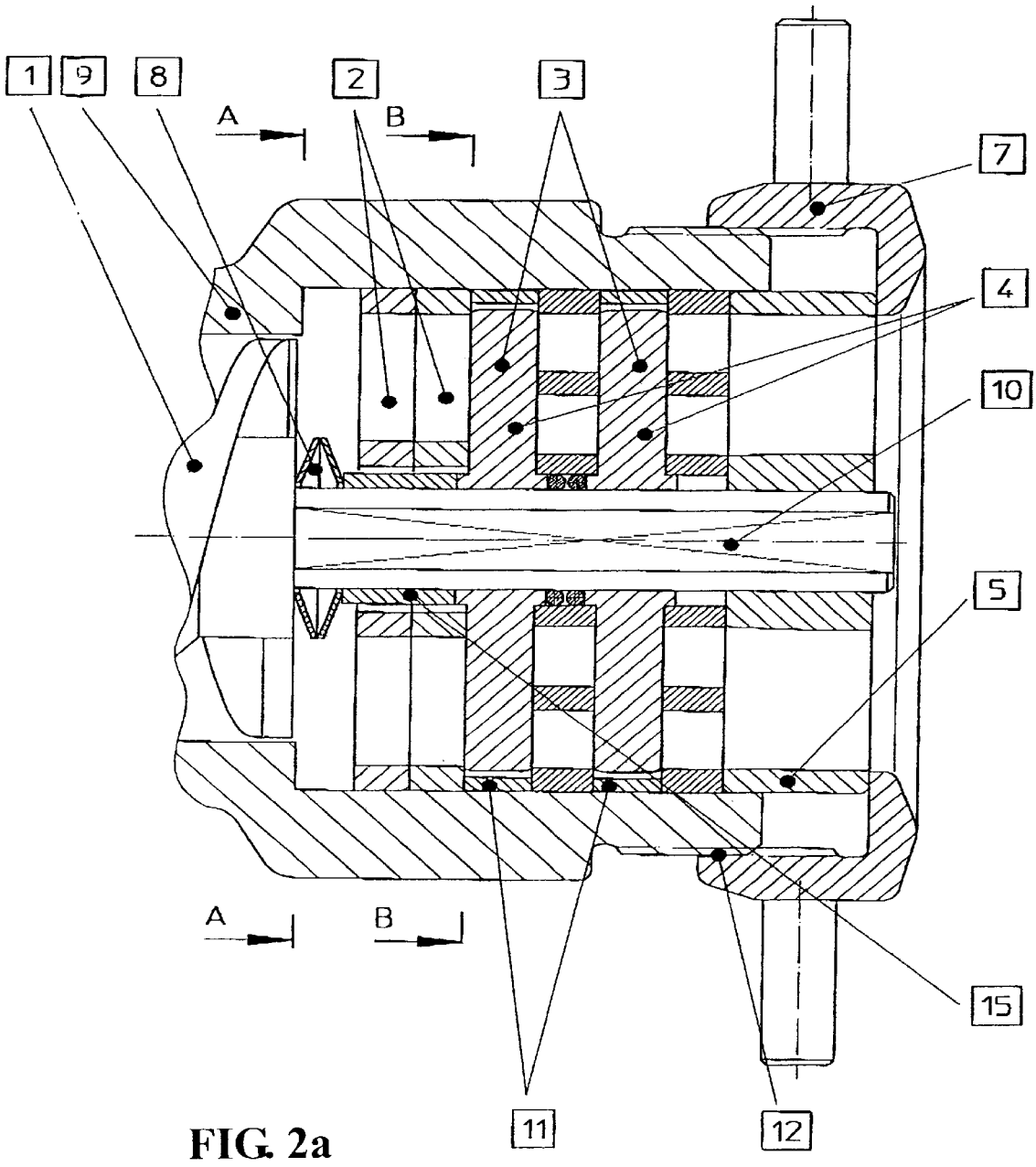

In the grinder of FIGS. 1 and 2, the front end of the worm housing 9 is illustrated, which receives the worm conveyor 1, which is provided at its front end with a drive shaft 10. Onto this drive shaft 10 a set of blades is mounted, which consists of two carving blades 2 and a perforated disc 4, the perforated disc and the carving blades being arranged by means of a spacer ring 11 at a predetermined distance from each other. Between one of the carving blades 2 and the perforated disc 4, a blade 3 is employed, which is arranged on the shaft 10 in an axially displaceable fashion in relation to the carving blades 2 and perforated disc 4, yet non-rotatably. The displacement distance of the blade 3 between the carving blades 2 and the perforated disc 4 corresponds to the difference between the spacer ring 11 and the height of the blade 3. This displacement distance grows with increasing wear.

The perforated disc 4 is in turn supported by a support cross 5 and a compensation ring 6 opposite a cap nut 7, which can be screwed onto an external thread 12 of the worm housing 9. The set of blades is firmly clamped with the aid of the cap nut 7, the relative axial displaceability of the blade 3 defined by the spacer ring 11 remaining unchanged irrespective of the tightening force.

The carving blade 2 and the perforated discs 4 have an inner diameter which is greater than shaft 10, so that in the intermediate space between the shaft 10 and the carving blade 2 a compression spring can be arranged which, on the one hand, rests against the end of the worm conveyor 1 and, on the other hand, against the hub of the blade 3. As a result, the blade 3 is kept pressed against the perforated disc 4 with a defined initial loading pressure, even when the height of the blade 3 declines due to wear. Advantageously, the pressing force which is exerted by the compression spring 8 on the blade 3 can be adjusted. Such an adjustment means is not illustrated in the drawing.

Figure 3:
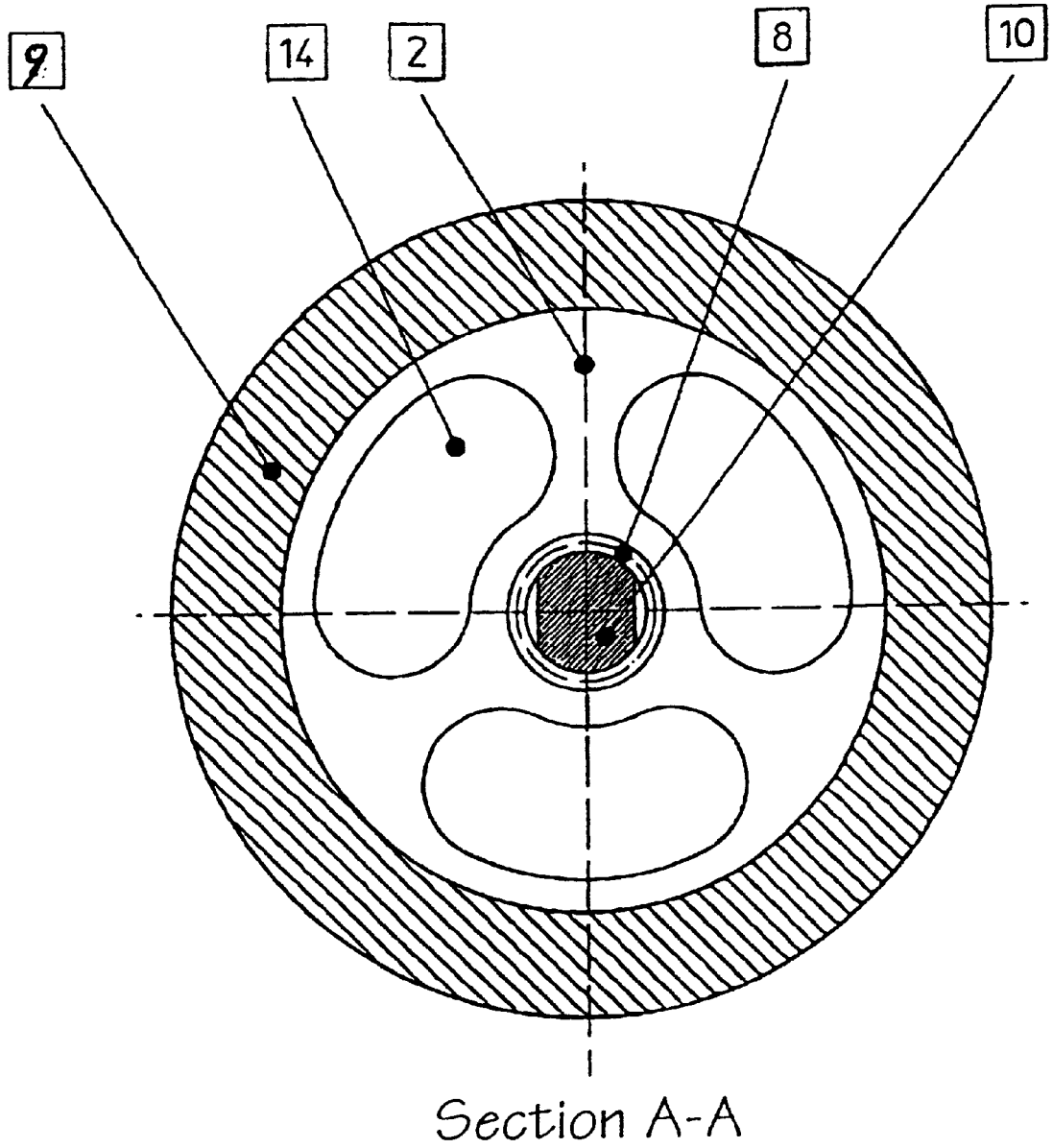
FIG. 3 is a sectional view along line A—A in FIG. 1.

FIG. 3 shows a sectional view along line A—A of the carving blade with its three openings 14.

Figure 4:
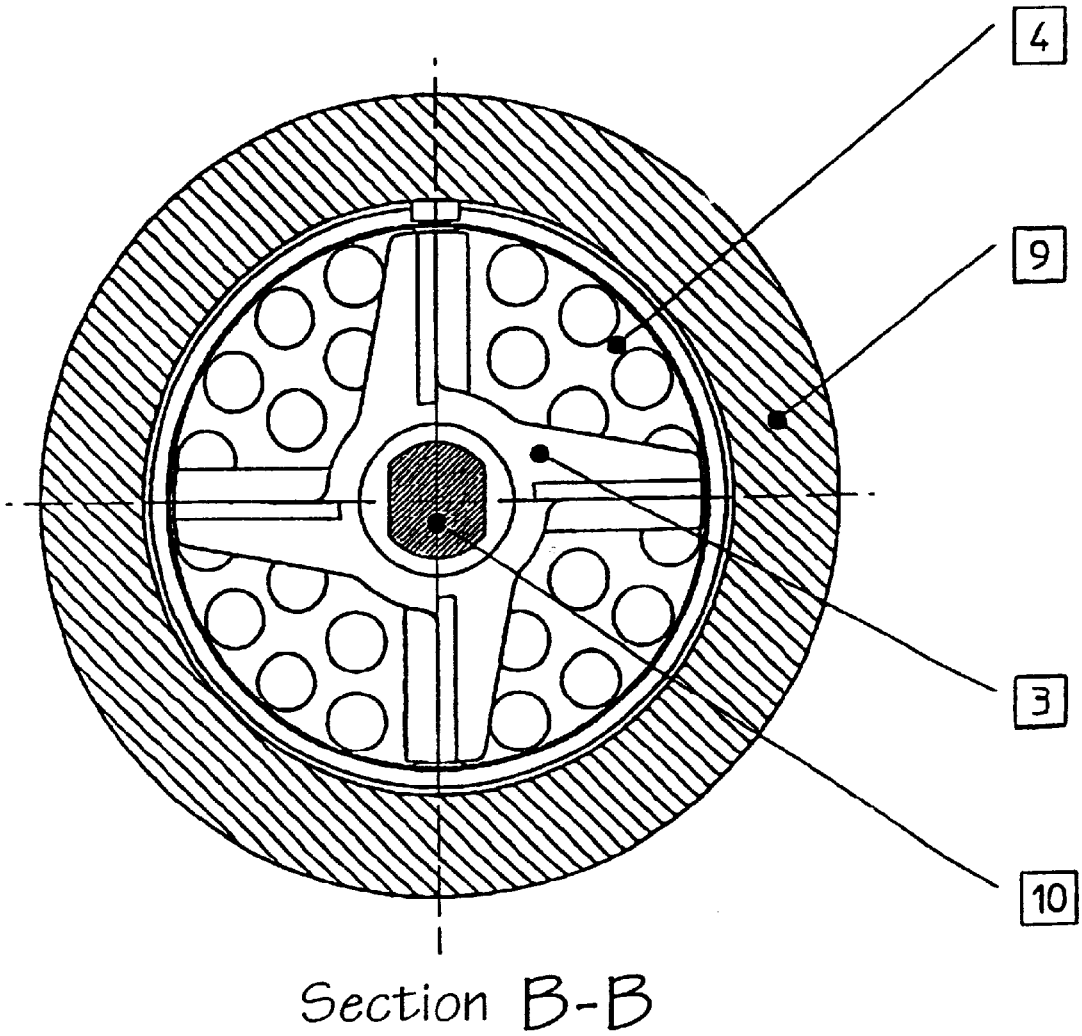
FIG. 4 is a sectional view along line B—B in FIG. 1.

FIG. 4 shows a sectional view along line B—B, with the perforated disc 4 and the blade 3 being shown in plan view.

The embodiment illustrated in FIG. 2 differs from that in FIG. 1 in that here, instead of a helical spring, a disc spring 8 has been used, which does not act directly upon the blade 3, but via a pressure bushing 15 which projects into the intermediate space between the shaft 10 and the carving blade 2.

The advantage of the set-up according to the invention is that the cutting pressure is not determined by the cap nut, as is the case in the prior art, thus giving rise to the risk that the cutting pressure will vary according to the tightening torque.

Overall, wear is reduced by the solution according to the invention and the service life of the set of blades is extended, whereby it is possible without difficulty to cut fresh meat and frozen meat without any changes having to be made to the set of blades or worm conveyor.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A grinder, particularly for the grinding of frozen and fresh meat, comprising a worm conveyor (1), a drive shaft (10), and a set of blades which comprising a carving blade (2) arranged after the worm conveyor (1), a perforated disc (4) arranged after the carving blade (2) at a fixed distance, a driven blade (3) arranged between the carving blade (2) and the perforated disc (4), and a spring (8) disposed between the worm conveyor (1) and the driven blade (3) to bias the driven blade (3) toward the perforated disc (4), the set of blades being clamped by a cap nut (7) in a worm housing (9), wherein the distance from the carving blade (2) to the perforated disc (4) is equal to or slightly greater than an axial extension of the driven blade (3), and wherein the driven blade (3) is arranged on the drive shaft (10) in an axially displaceable fashion and pressed against the perforated disc (4) with a predetermined initial spring loading provided by the spring (8).

2. The grinder according to claim 1, wherein the carving blade (2) has a greater inner diameter than a diameter of the drive shaft (10), and wherein a pressure element (15) acting upon the blade (3) by force of the spring (8) is arranged in an intermediate space between the drive shaft (10) and the carving blade (2).

3. The grinder according to claim 1, wherein the carving blade (2) comprises two parts pressed against each other.

4. The grinder according to claim 1, wherein the perforated disc (4) is followed by at least one other perforated disc (4) at a fixed distance, between which a spring-loaded driven blade (3) is arranged.

5. The grinder according-to claim 2, wherein the pressure element (15) is a spring-loaded bushing.

6. The grinder according to claim 5, wherein the spring (8) is a disc or helical spring.

7. The grinder according to claim 6, wherein the pressure element (15) includes the helical spring (8).

* * * * *